US005130683A

United States Patent [19]

Agahi-Kesheh et al.

[11] Patent Number: 5,130,683

[45] Date of Patent: Jul. 14, 1992

[54] HALF WAVE RESONATOR DIELECTRIC FILTER CONSTRUCTION HAVING SELF-SHIELDING TOP AND BOTTOM SURFACES

[75] Inventors: Darioush Agahi-Kesheh, Buffalo Grove, Ill.; Raymond L. Sokola; Frederick L. Sassin, both of Albuquerque, N. Mex.

[73] Assignee: Motorola, Inc., Schaumburg, Ill.

[21] Appl. No.: 678,419

[22] Filed: Apr. 1, 1991

[51] Int. Cl.[5] ..... H01P 1/202; H01P 1/205

[52] U.S. Cl. ..... 333/203; 333/206; 333/134

[58] Field of Search ..... 333/202, 203, 206, 207, 333/222, 219, 227, 134; 455/78

[56] References Cited

U.S. PATENT DOCUMENTS 4,431,977 2/1984 Sokola et al. ..... 333/206
4,879,533 11/1989 de Muro et al. ..... 333/202 X

FOREIGN PATENT DOCUMENTS 0169802 7/1988 Japan ..... 333/202
0000801 1/1989 Japan ..... 333/206
0053601 3/1989 Japan ..... 333/202

*Primary Examiner*—Eugene R. LaRoche
*Assistant Examiner*—Seung Ham
*Attorney, Agent, or Firm*—Robert H. Kelly

[57] ABSTRACT

A dielectric block filter construction having resonating cavities formed therein to form one half wave-wavelength resonators thereby. The resonating cavities span opposing side surfaces of the dielectric block forming the dielectric block filter to define openings at the opposing side surfaces. Outer surfaces of the dielectric block, including the opposing side surfaces having the openings defined thereat, are coated with an electrically-conductive material except for portions of one side surface of the dielectric block about peripheral surfaces of input and output couplers formed on the one surface. Because the opposing outer surfaces are coated with the electrically-conductive material, the opposing outer surfaces of the dielectric block are self-shielding to prevent propagation of electromagnetic radiation through openings defined by the resonating cavities of the dielectric block.

12 Claims, 2 Drawing Sheets

HALF WAVE RESONATOR DIELECTRIC FILTER CONSTRUCTION HAVING SELF-SHIELDING TOP AND BOTTOM SURFACES

BACKGROUND OF THE INVENTION

The present invention relates generally to dielectric filters, and, more particularly, to a dielectric filter construction which forms a one half-wave wavelength resonator.

The design and use of filter circuitry for filtering a signal of undesired frequency components is well known. For example, filter circuitry for performing bandpass, band reject, low pass, and high pass functions are all well-known, and are utilized to form portions of electrical circuits. Combinations of such filter circuits are additionally well-known and are utilized to form portions of electrical circuits. Such filter circuitry permits passage of, or rejection of, certain frequency component portions of a signal applied to the filter circuitry. The component portions of the signal applied to the filter which are passed, or rejected, by the filter is, of course, a function of the characteristics of the filter.

Filter circuitry may be formed of either active or passive filter components. Active filter components are advantageously utilized to embody the filter circuitry within an integrated circuit. However, filter circuitry comprised of active filter components is generally linear over only a limited dynamic range. Additionally, filter circuitry comprised of active filter components exhibit desired filter characteristics over only the limited dynamic range.

Filters comprised of passive filter components are therefore commonly utilized to embody the filter circuitry. Passive filter components of which the filter circuitry may be comprised include for example, combinations of resistors, capacitors, and inductors. The resistive, capacitive, and inductive component values of such passive filter components, and their respective electrical connections therebetween, define a resonant frequency. The passive filter components may be connected in manners, and may be of resistive, capacitive, and inductive values, to form any of the above-listed types of filter circuitry.

Filter circuitry forming a portion of an electrical circuit may, for example, be positioned in a series connection with the electrical circuit. When signals generated by, or applied to, the electrical circuit are supplied to series-connected filter circuitry, signal portions (i.e., frequency component portions) of the signal applied to the filter circuitry within the resonant frequency defined by the component values of component portions of the filter circuitry are passed therethrough. Appropriate selection of the component values of passive filter components, as well as their electrical connection therebetween, causes the filter circuitry to pass, or to reject, signal portions of any selected range of frequencies.

Filter circuitry forming a portion of an electrical circuit may, conversely, be positioned in a shunt connection with other portions of the electrical circuit (i.e., the filter circuitry may be positioned to extend between the electrical circuit and a ground plane). Similar to the series-connected filter circuitry, the values of the passive filter components, and their respective electrical connections therebetween, define a resonant frequency. When the filter circuitry is connected to the electrical circuit in such a shunt connection, signal portions (i.e., frequency component portions), of a signal applied to the filter circuitry within the resonant frequency of the filter circuitry are shunted to ground by filter circuitry. By appropriate selection of the component values of the components of the filter circuitry, as well as their respective electrical connection therebetween, any of the above-listed circuitry may be formed.

Combinations of both filter circuitry connected in the series-connection and the shunt-connection may, of course, be formed, to perform circuit functions as desired.

A radio frequency receiver circuit comprises one type of electrical circuit which utilizes filter circuitry to form a portion thereof. Such filter circuitry is utilized, for example, to tune the receiver, and to filter intermodulation spurs generated during down conversion and demodulation of a signal received by the receiver circuit. Actual, non-ideal receiver circuits generate intermodulation distortion during down conversion of the received signal. Additionally, spurious signals are generated during down conversion of a signal received by such a non-ideal receiver circuit. Filter circuitry is utilized to reject such intermodulation distortion generated during the down-conversion and/or demodulation process. Filter circuitry is, of course, utilized in receiver circuits to perform other filter functions.

Passive filter circuits are oftentimes comprised of ceramic and other dielectric materials. Such filter circuitry is commonly referred to as a "ceramic block filter" because of the geometric configuration of most of such filters. Conventionally, the ceramic block filter is formed in the shape of a block, and one or more holes are drilled or otherwise formed to extend into the block. Such holes (i.e., cavities) form resonating cavities which resonate at frequencies determined by the length of the cavity. Portions of the sidewalls defining the cavity are coated with an electrically-conductive material, such as a silver-containing compound. Portions of surfaces, or entire surfaces, of the ceramic block are also typically covered with the electrically-conductive material.

The surface area of the sidewalls which define the cavities additionally determine the resonating frequency of the resonator formed therefrom. Holes may be drilled (i.e., the cavities may be formed) to extend in any direction. Typically, however, the holes are formed to extend between opposing surfaces of the ceramic block, such as, for example, between top and bottom surfaces, or between front and rear surfaces of the ceramic block. The ceramic block filter may be connected in series, or in shunt, to perform filter functions as desired. Ceramic block filters and/or apparatus for connecting such filters to an electrical circuit are disclosed in U.S. Pat. Nos. 4,431,977; 4,673,902; 4,703,921; 4,716,391; and 4,742,562.

Because many electrical devices are packaged in ever-smaller housings, the electrical circuit comprising portions of the electrical devices must be miniaturized to permit positioning of the electrical circuits within the ever-smaller housings.

For example, portable transceivers, such as portable, cellular phones, are increasingly miniaturized to permit the transceiver to be of ever smaller dimensions. Electrical circuits of such portable transceivers include both receiver circuitry and transmitter circuitry each of which may utilize one or more ceramic block filters for filtering signal portions of signals received by the receiver circuitry, and for filtering signal portions of the signals generated by the transmitter circuitry. The ceramic block filters may, for instance, form interstage filters positioned between stages of the transmitter and/or receiver circuitry, or form a duplexer filter positioned between the receiver circuitry and an antenna and between the antenna and the transmitter circuitry.

Typically, the ceramic block filter is mounted upon a circuit board, such as a printed circuit board, and is suitably connected to an electrical circuit disposed, or mounted, thereupon. Because of the geometric configuration of the ceramic block filter, a minimum heightwise spacing is required above the circuit board to permit mounting of the ceramic block filter thereupon. More particularly, when the circuit board upon which the filter is mounted to be positioned with a transceiver housing, the circuit board must be positioned a distance at least as great as the distance of such minimum heightwise spacing beneath the inner surface of the housing of the transceiver. Similarly, when two or more circuit boards are to be stacked upon one another, the distance between the circuit boards must similarly be at least as great as such minimum heightwise spacing. This heightwise spacing necessitated by the geometric configuration of the ceramic block filter may limit the miniaturization permitted of an electrical device, such as the portable transceiver as above-mentioned.

Various means have been suggested for reducing the minimum heightwise distance required for mounting a ceramic block filter upon a circuit board.

Most simply, the dielectric block filter may be positioned upon the circuit board such that the axially extending resonators formed to extend through at least portions of the dielectric block filter, extend in directions parallel to the planar direction of the circuit board. However, such positioning of the dielectric block filter requires significant amounts of surface area of the circuit board to be positioned in such a manner. When the resonators formed to extend through the dielectric block are of lengths corresponding to a one half-wavelength—i.e., one half of the wavelength of the resonating frequency of the resonator, the surface area required for such positioning of the dielectric block filter is particularly significant. For instance, when the resonating frequencies of the resonators are to be approximately 900 MHz, the length of the resonating cavities are approximately sixteen and one half centimeters in length.

Additionally, U.S. patent application Ser. No. 455,062, filed on Dec. 22, 1989, discloses a dielectric block filter which is of dimensions permitting the positioning thereof through a opening formed to extend through a circuit board. A bracket is positioned about the ceramic block filter to affix the filter to the circuit board. Also, U.S. patent application Ser. No. 07/577,172 filed Sept. 4, 1990 to Michael T. Metroka discloses a dielectric block filter which may be similarly positioned to extend into an opening formed through the circuit board, but which obviates the need of a bracket to affix the filter to the circuit board.

However, such dielectric block filter constructions typically require a shielding bracket to be positioned at an end surface of the dielectric block to prevent radiation emitted through an end portion of the dielectric block from interfacing with operation of other portions of the electrical circuit, or other electrical circuits. The shielding bracket, comprised of a metallic material, is required to cover the end portion of the dielectric block to prevent transmission of electromagnetic waves from an exposed surface of the dielectric block. Such transmission of electromagnetic waves would otherwise interfere with circuit operation of electrical circuits positioned proximate to the dielectric block filter. Such shielding brackets, however, necessitate additional surface area of the circuit board, and, additionally, require an extra production step to position the bracket about the end surface of the dielectric block filter during mounting thereof upon the circuit board.

What is needed, therefore, is a dielectric filter construction which forms a one half-wave wavelength resonator and which obviates the need of a shielding bracket formed about an end surface thereof.

SUMMARY OF THE INVENTION

The present invention, accordingly, advantageously provides a dielectric filter construction forming a one half-wave wavelength resonator.

The present invention further advantageously provides a dielectric filter construction having self-shielding surfaces for preventing transmission of electromagnetic radiation therefrom.

In accordance with the present invention, therefore, a filter construction for generating a filtered signal responsive to application of an input signal thereto is disclosed. The filter construction comprises a dielectric block having at least one pair of coaxially-extending resonators formed to extend between first and second sides of the dielectric block. The first and second sides of the dielectric block are maintained at a common electric potential. An input coupler is formed upon the side of the dielectric block other than the first and second sides, respectively of the dielectric block, and an output coupler is formed upon a side of the dielectric block other than the first and second sides, respectively, of the dielectric block.

BRIEF DESCRIPTION OF THE DRAWINGS

The present invention will be better understood when read in light of the accompany drawings in which.

DESCRIPTION OF THE PREFERRED EMBODIMENTS

Figure 1:
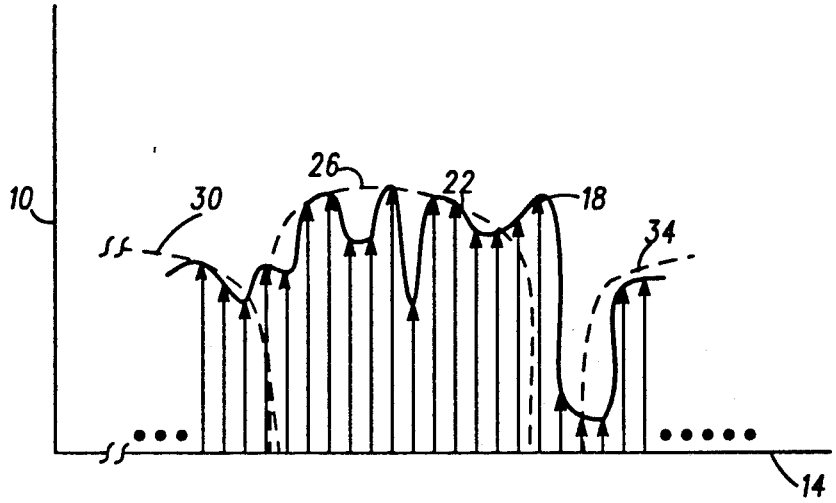
FIG. 1 is a graphical representation of a signal plotted as a function of frequency which may be filtered by the dielectric filter of the present invention.

Turning first to FIG. 1, a signal, such as a voice signal or a modulated voice signal is plotted upon an axis system defined by ordinate axis 10 and abscissa axis 14. The power of the signal, scaled in terms of watts, milliwatts, or dB on ordinate axis 10, is plotted as function of frequency, scaled in terms of hertz on abscissa axis 14. As plot of FIG. 1 illustrates, a typical signal is actually the summation of a plurality of signal component portions, represented in the plot of FIG. 1 by vertically-extending arrows 18 (i.e., spikes), each of a different frequency value.

The various component portions of the signal, each defined by one of the plurality of vertically-extending arrows 18, are summed theretogether to form envelope 22. Because a typical signal, although conventionally represented by the envelope 22, is actually comprised of a large number of spectral components over a broad range of frequencies, a typical signal is oftentimes referred to as a "broadband" signal. It is noted that, although the signal of FIG. 1 is represented by a plurality of vertically-extending arrows 18, an actual signal is comprised of a sum of signals having frequencies centered at the frequencies of the vertically-extending arrows 18.

A filter functions to pass certain spectral (i.e. frequency) portions of a signal, and to reject other spectral (i.e., frequency) portions of the signal. Envelope 26, shown in hatch, represents a passband of a bandpass filter which passes spectral component portions of a signal applied to the filter within the passband of the filter; other spectral component portions of the signal are rejected, and are not passed by the filter. Envelope 30, also shown in hatch in FIG. 1, is representative of a low pass filter. Spectral component portions of a signal applied to the filter within the passband of a low pass filter are passed by the low pass filter; other spectral component portions of the signal are rejected and are not passed. Similarly, envelope 34, also shown in hatch in FIG. 1, is representative of the passband of a high pass filter. Spectral component portions of a signal applied to a high pass filter within the passband of the high pass filter are passed by the high pass filter; other spectral component portions of the signal are rejected, and are not passed by the filter. Combinations of high pass, low pass, and bandpass filters can together form other types of filter circuitry, such as, for example, a band reject filter.

Figure 2:
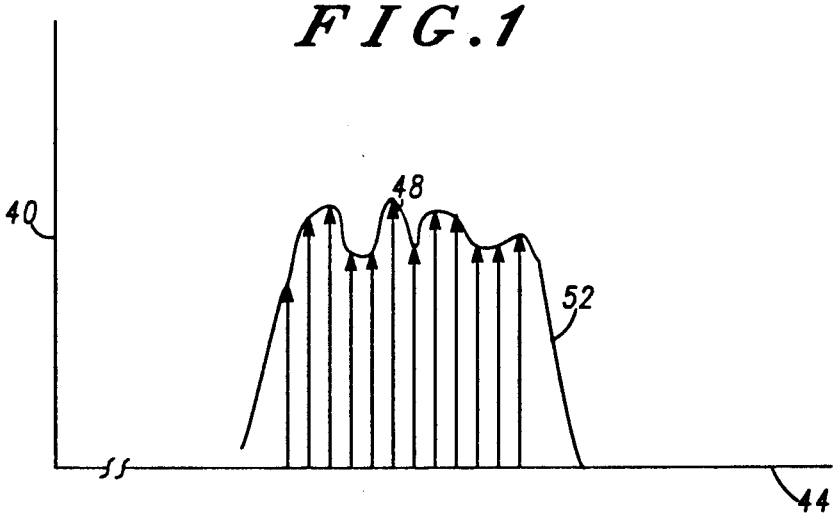
FIG. 2 is a graphical representation, similar to the graphical representation of FIG. 1, but illustrating a filtered signal formed by a dielectric filter constructed according to the teachings of the present invention responsive to application of the signal of FIG. 1 thereto.

FIG. 2 is a graphical representation, similar to that of FIG. 1, wherein the power of a signal, scaled in terms of watts, milliwatts, or dB is plotted upon ordinate axis 40 as a function of frequency, scaled in terms of hertz on abscissa axis 44. The signal plotted in FIG. 2 is that of a filtered signal which is formed of the spectral component portions of a broadband signal applied to the filter. The filtered signal plotted in FIG. 2 is comprised of the spectral component portions of the broadband signal of FIG. 1 within the range of frequencies defined by envelope 26 of FIG. 1 Spectral component portions of other broad-band signals comprised of other spectral component portions similarly applied to the filter which are within the passband of the filter are similarly passed by the filter. Spectral component portions of the signal applied to the filter beyond the passband of the bandpass filter are not passed by the filter and are rejected by the filter. Again, although the filtered signal passed by the bandpass filter represented in the graphical representation of FIG. 2 is represented by vertically-extending arrows, here arrows 48, an actual filtered signal is actually the resultant sum of signals having center frequencies at the frequencies of arrows 48, and the resultant, filtered signal may be graphically represented by envelope 52.

Figure 3:
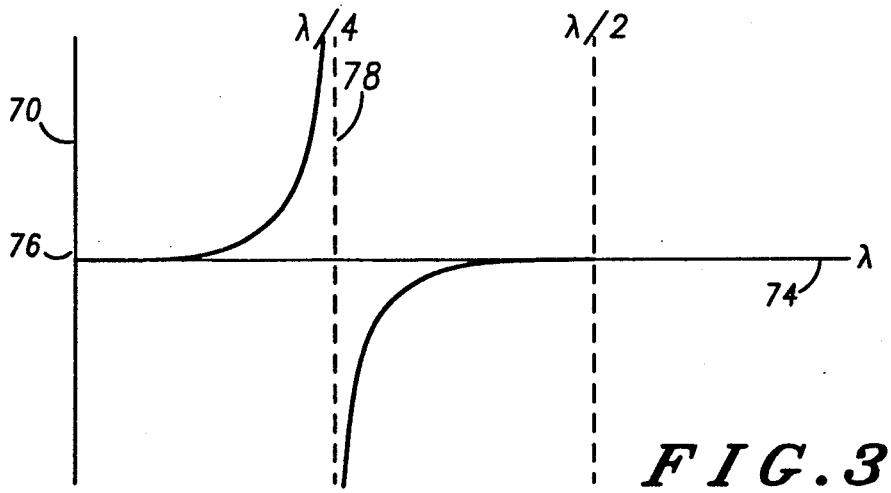
FIG. 3 is a graphical representation in which the impedance characteristics of an ideal, one half-wave wavelength transmission line filter are plotted as a function of the length of the filter resonator, scaled in terms of wavelength.

Turning now to the graphical representation of FIG. 3, the impedance characteristics of an ideal, one half-wave, wavelength transmission line filter is plotted on ordinate axis 70 as a function of wavelength (i.e., $\lambda$) of a signal applied to the filter along abscissa axis 74. Origin 76 represents a short circuit at which impedance is of a zero value. A ceramic block filter having a resonating cavity may be similarly represented. An actual ceramic block filter differs from an ideal transmission line filter, of course, in that an ideal transmission line filter has associated therewith an infinite dielectric constant, Q, whereas an actual dielectric block filter has associated therewith a dielectric constant Q of a finite value.

Examination of the plot of FIG. 3 indicates that, as the length of the transmission line filter (and, correspondingly, the length of the resonating cavities of a dielectric block filter) approaches a length of a one quarter-wavelength of the signal applied thereto, indicated by vertically-extending line 78 shown in hatch, the impedance of the filter increases rapidly to be of a large value. As the length of the transmission line filter (and, again, correspondingly, the length of the resonating cavities of the dielectric block filter) approaches a length of a value of a one half-wavelength of the signal applied thereto, indicated by vertically-extending line 82 shown in hatch, the impedance of the filter approaches a value of zero. By short circuiting both ends of a transmission line filter, the line resonates at a frequency of a one half-wave wavelength (i.e., $\lambda/2$). Similarly, by short circuiting both ends of a dielectric block filter, the resonating cavities of the filter resonate at a frequency of a one half-wave wavelength. For instance, a dielectric block filter having resonating cavities constructed to resonate when a signal applied thereto is of a frequency of approximately 900 megahertz contains resonating cavities of approximately sixteen and one-half centimeters in length. It is additionally noted that a dielectric block filter having resonating cavities of multiples of the one quarter-wavelength and one half-wavelengths similarly resonate, and a plot of the impedance characteristics of such a dielectric block filter plotted as a function of time is similar to the plot FIG. 3.

Figure 4:
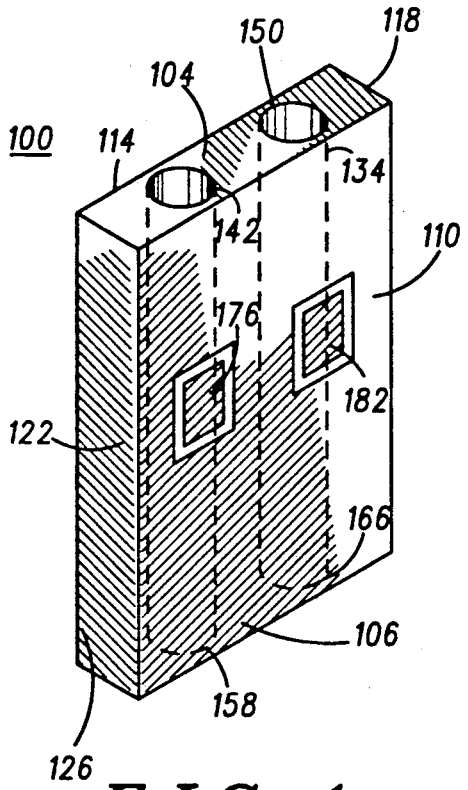
FIG. 4 is an orthogonal view of a dielectric block filter of a preferred embodiment of the present invention.

Turning now to the orthogonal view of FIG. 4, a dielectric block filter, referred to generally by reference numeral 100, of the preferred embodiment of the present invention is shown. Filter 100 is cubular in shape having top surface 104, bottom surface 106, front side surface 110, rear side surface 114, and side surfaces 118 and 122. Resonating cavities 126 and 134 are formed, by a boring process or otherwise, to extend between top surface 104 and bottom surface 106. Resonating cavities 126 and 134 define openings 142 and 150, respectively upon top surface 104. Similarly, resonating cavities 126 and 134 define openings 158 and 166, respectively, upon bottom surface 106.

An electrically-conductive material, such as a silver-containing material, is coated upon outer surfaces of top and bottom surfaces 104 and 106, side surfaces 118 and 122, and rear surface 114 to substantially cover the surfaces thereby. Additionally, the electrically-conductive material coats the sidewalls which define resonating cavities 126 and 134 to cover substantially the sidewalls of the respective resonating cavities thereby. The electrically-conductive material coating top surface 104 is thereby maintained in electrical connection with the electrically-conductive material coating bottom surface 106.

The electrically-conductive material is additionally coated upon portions of front surface 110 of the filter 100. In particular, the electrically-conductive material is coated upon rectangular portions of front surface 110 to form input and output couplers 176 and 182 thereby. Remaining portions of front surface 110 are also coated with the electrically-conductive material except for portions of front surface 110 positioned above the periphery of input and output couplers 176 and 182, respectively. Input and output couplers 176 and 182 are thereby capacitively coupled to the electrically-conductive material coated upon the surface areas of filter 100 as well as to the resonating cavities 126 and 134, respectively.

The dielectric block filter 100 is constructed such that the lengths of resonating cavities 126 and 134 are of lengths approaching one half-wavelengths of a signal applied to input coupler 176 to form resonators of the resonating cavities thereby. Because both the top and bottom surfaces 104 and 106 of filter 100 are substantially covered with the coating of electrically-conductive material, and are maintained in electrical connection to be of a common electrical potential, electromagnetic radiation is not radiated through openings 142 or 150 defined upon top surface 104, or through openings 158 or 166 defined upon bottom surface 106, but, rather, resonating cavities 126 and 134 are coupled theretogether through the material of dielectric filter 100. Resonating cavities 126 and 134, each of lengths approaching one half-wavelength lengths of a signal applied to input coupler 176, together comprise a one half-wave wavelength resonator thereby.

An input signal applied to input coupler 176 is filtered by filter 100 which generates a filtered signal at output coupler 182. Spectral component portions of desired characteristics (i.e., desired frequencies) of the input signal applied to input coupler 176 are passed by the filter 100 and form a filtered, output signal at output coupler 182. Other spectral component portions of the input signal applied to input coupler 176 are not passed by filter 100, and do not form a portion of the filtered, output signal at coupler 182.

Figure 5:
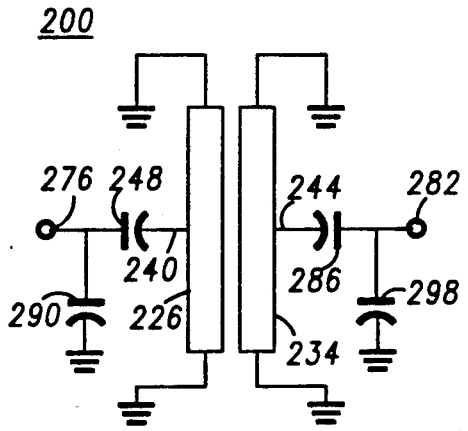
FIG. 5 is a circuit diagram of the filter of FIG. 4.

Turning now to the circuit diagram of FIG. 5, an electrical circuit, referred to generally by reference numeral 200, is shown. Electrical circuit 200 illustrates schematically the circuit formed of dielectric block filter 100 of FIG. 4, and includes resonating cavities 226 and 234. Resonator 226 is connected in a series connection at node 240, and corresponds to resonating cavity 126 of FIG. 4. Similarly, resonator 234 is connected in a series connection at node 244, and corresponds to resonating cavity 134 of FIG. 4.

Node 240 is capacitively coupled to coupler 276 through capacitor 248. Coupler 276 corresponds to input coupler 176 formed on front surface 110 of filter 100 of FIG. 4. Capacitor 248 represents the capacitive coupling between input coupler 176 and resonating cavity 126 of FIG. 4. Similarly, node 244 is capacitively coupled to coupler 282 through capacitor 286. Coupler 282 corresponds to output coupler 182 formed on front surface 110 of filter 100 of FIG. 4. Capacitor 286 represents the capacitive coupling between output coupler 282 and resonating cavity 134 of FIG. 4.

Circuit 200 of FIG. 5 further illustrates capacitor 290 connected between node 276 and ground. Capacitor 290 represents the capacitive coupling between input coupler 176 of FIG. 4 and the ground plane of filter 100 comprised of the electrically-conductive material coating upon surfaces 104–122 of filter 100 and upon the sidewalls which define resonating cavities 126 and 134 of FIG. 4. Similarly, circuit 200 of FIG. 5 additionally illustrates capacitor 298 connected between node 282 and ground. Capacitor 298 represents the capacitive coupling between output coupler 182 of FIG. 4 and the ground plane of filter 100 comprised of the electrically-conductive material coated upon surfaces 104–122 of filter 100 and upon the sidewalls which define resonating cavities 126 and 134 of FIG. 4. Suitable selection of the capacitive values of capacitors 248, 286, 290, and 298 (i.e., both the amount of electrically-conductive material coated upon surfaces 104–122 of filter 100 and the spacing between such coating and the input and output couplers 176 and 182, respectively) permits desired filter characteristics of a filter, such as filter 100 of FIG. 4 and represented by electrical circuit 200 of FIG. 5, to be obtained.

Figure 6:
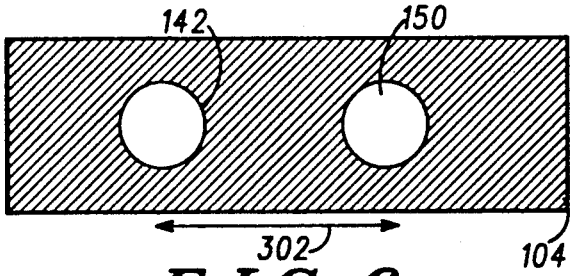
FIG. 6 is an overhead view of the filter of FIG. 4.

It is to be additionally noted that end portions of resonators 226 and 234 of FIG. 5 are coupled to ground. Such coupling to ground represents the electrical connection of resonating cavities 126 and 134 of FIG. 4 to the ground plane of the electrically-conductive material coating surface portions of filter 100 of FIG. 4. FIG. 6 illustrates an overhead view of filter 100 of FIG. 4. The overhead view of FIG. 6 illustrates top surface 104 of filter 100 and openings 142 and 150 defined by resonating cavities 126 and 134 extending through the filter 100. Arrow 302 indicates the distance between central axes of resonating cavities 126 and 134 which also defines the center of openings 142 and 150. Appropriate spacing of the resonating cavities 126 and 134, that is, the lengths of distances defined by arrow 302 is determinative of the bandwidth of a passband of filter 100 formed therefrom. As the lengths of the resonating cavities 126 and 134 determine a center frequency of a passband of a dielectric block filter, such as filter 100 of FIG. 4, and the spacing between the coaxially-extending resonating cavities 126 and 134 defines the bandwidth of the passband of the filter, a passband located at any location in frequency and of any desired bandwidth may be constructed of the filter 100. It is also noted that the bandwidth of the filter is also affected by the shape of the resonating cavities and, hence, the shape of the openings formed therefrom. For instance, by elongating the resonating cavities relative axially-extending axes thereof (to form elliptical openings thereby), the bandwidth of the filter is increased.

Figure 7:
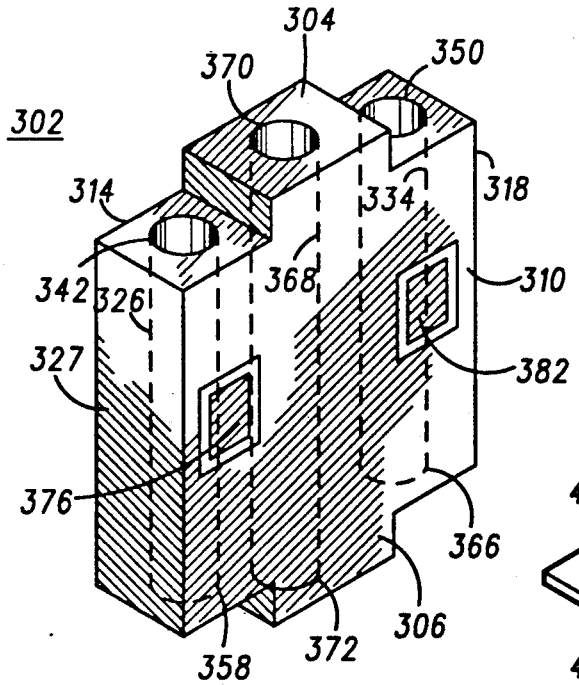
FIG. 7 is an orthogonal view of a dielectric block filter of an alternate embodiment of the present invention.

Turning now to the orthogonal view of FIG. 7, a dielectric block filter, referred to generally by reference numeral 302 of an alternate embodiment of the present invention is shown Filter 302 is generally cubular in shape, but includes bifurcated top and bottom surfaces 304 and 306, respectively, as contrasted to flat top and bottom surfaces 104 and 106 of filter 100 of FIG. 4. As illustrated, filter 302 further includes front side surfaces 310, rear side surface 314, and side surfaces 318 and 322. Resonating cavities 326 and 334 are formed, by a boring process or otherwise, to extend between top surface 304 and bottom surface 306. Resonating cavities 326 and 334 define openings 342 and 350, respectively upon top surface 304. Similarly, resonating cavities 326 and 334 define openings 358 and 366, respectively, upon bottom surface 306. Filter 302 of FIG. 7 further includes resonating cavity 368 (also formed by a boring process or otherwise) to extend between top and bottom surfaces 304 and 306 which defines openings 370 and 372 upon the respective surfaces 304 and 306. Because of the bifurcated construction of surfaces 304 and 306, cavity 368 is elongated relative to cavities 326 and 334.

An electrically-conductive material, such as a silver-containing material, is coated upon outer surfaces of top and bottom surfaces 304 and 306, side surfaces 318 and 322, and rear surface 314 to substantially cover the surfaces thereby. Additionally, the electrically-conductive material coats the sidewalls which define resonating cavities 326, 334, and 368 to cover substantially the sidewalls of the respective resonating cavities thereby. The electrically-conductive material coating top surface 304 is thereby maintained in electrical connection with the electrically-conductive material coating bottom surface 306.

The electrically-conductive material is additionally coated upon portions of front surface 310 to form input and output couplers 376 and 382 thereby. Remaining portions of front surface 310 are also coated with the electrically-conductive material except for portions of front surface 310 positioned above the periphery of input and output couplers 376 and 382, respectively. Input and output couplers 376 and 382 are thereby capacitively coupled to the electrically-conductive material coated upon the surface areas of filter 100 as well as to the resonating cavities 326 and 334, respectively.

The dielectric block filter 302 is constructed such that the lengths of resonating cavities 326 and 334 are of lengths somewhat less than one half-wavelengths of a signal applied to input coupler 376, and resonating cavity 368 is of a length approaching one half-wavelengths of a signal applied to input coupler 376 to form resonators of the resonating cavities thereby. Because both the top and bottom surfaces 304 and 306 of filter 302 are substantially covered with the coating of electrically-conductive material, and are maintained in electrical connection to be of a common electrical potential, electromagnetic radiation is not radiated through openings 342, 350, or 170 defined upon top surface 304, or through openings 358, 366, or 372 defined upon bottom surface 306, but rather, resonating cavities 326 and 334 are coupled theretogether through the material of dielectric filer 302. The resonating cavities together comprise a one half-wave wavelength resonator thereby.

An input signal applied to input coupler 376 is filtered by filter 302 which generates a filtered signal at output coupler 382. Spectral component portions of desired characteristics (i.e., desired frequencies) of the input signal applied to input coupler 376 are passed by the filter 302 and form a filtered, output signal at output coupler 382. Other spectral component portions of the input signal applied to input coupler 376 are not passed by filter 302 and do not form a portion of the filtered, output signal at coupler 382.

Figure 8:
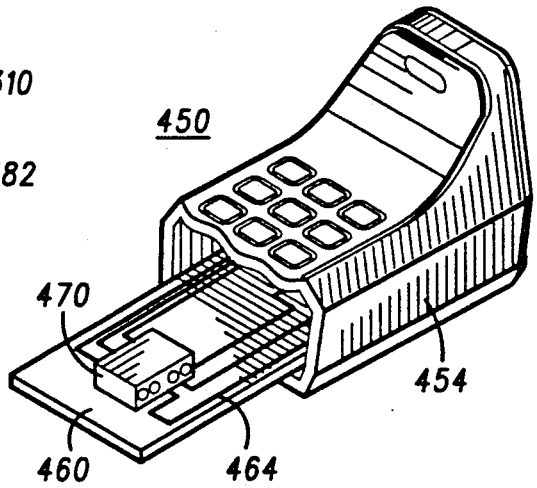
FIG. 8 is a cut-away view of a radiotelephone having an electric circuit board having an electrical circuit disposed thereupon, and a dielectric block filter, similar in construction to the filter of FIG. 4 mounted to thereupon.

Turning now to the cut-away view of FIG. 8, a radiotelephone of the present invention, referred to generally by reference numeral 450, which includes a dielectric block filter similar to that of filter 100 of FIG. 4 (or alternately filter 302 of FIG. 7) is shown. Radiotelephone 450 comprises housing 454 which supports therewithin one or more electrical circuit boards 460 upon which an electrical circuit 464 is disposed. Electrical circuit 464 comprises both transmit and receive portions. Dielectric block filter 470 is coupled to electrical circuit 464, filter 470 is similar in construction to that of dielectric block filter 100 of FIG. 4 (or, alternately, filter 302 of FIG. 7).

Filter 470 is surface mounted upon circuit board 460 by positioning of a side surface thereof, corresponding to front surface 110 of filter 100 of FIG. 4, in physical abutment against conductive leads forming portions of circuit 464. More particularly, appropriate connection of couplers disposed upon filter 470 (while not shown in the figure, couplers disposed upon filter 470 correspond to input and output couplers 176 and 182 of filter 100 of FIG. 4) permits electrical connections of filter 470 to electrical circuit 464.

Because filter 470 may be surface mounted such that the elongated portion thereof (i.e., the direction defined by the direction of the axis of resonating cavities of filter 470) extends in a direction parallel to the planar direction of circuit board 460, the heightwise spacing required beneath housing 454 to permit positioning of circuit board 460 beneath housing 454 of radiotelephone 450 is minimized. Additionally, because filter 470 is self-shielding, that is, because electromagnetic radiation is not radiated through openings formed on top and bottom surfaces of filter 470, no bracket is required to be positioned about either of the top or bottom of surfaces of filter 470. A dielectric block filter such as filter 470 may be advantageously utilized as an interstage filter, as well as a duplex filter, for a radiotelephone such as radiotelephone 450 of FIG. 7.

While the present invention has been described in connection with the preferred embodiments shown in the various figures, it is to be understood that other similar embodiments may be used and modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. A filter construction for generating a filtered signal responsive to application of an input signal thereto, said filter construction comprising:

a dielectric block defining top, bottom, and at least first and second side surfaces, and having at least one pair of coaxially-extending resonators formed to extend between the top and bottom surfaces of the dielectric block;

means forming an input coupler located upon at least one of one of the at least first and second side surfaces of the dielectric block coupled to a first resonator of the at least one pair of coaxially-extending resonators;

means forming an output coupler located upon at least one of one of the at least first and second side surfaces of the dielectric block coupled to a second resonator of the at least one pair of coaxially-extending resonators; and means for maintaining the top and the bottom surface at a common electrical potential, said means for maintaining forming a coating of an electrically-conductive material substantially covering the top, bottom, sidewalls defining the resonators of the at least one pair of coaxially-extending resonators and side surfaces of the dielectric block except about peripheral portions of the input and output couplers, the coating of the electrically-conductive material covering the top and bottom surfaces, respectively, thereby forming self-shielding surfaces thereof.

2. The filter construction of claim 1 wherein each resonator of said at least one pair of coaxially-extending resonators comprise means forming a cavity defining first openings at the top surface of the dielectric block and second openings at the bottom surface of the dielectric block.

3. The filter construction of claim 1 wherein the resonators forming each pair of said at least one pair of coaxially-extending resonators together form resonators approaching one half-wavelength in length.

4. The filter construction of claim 1 wherein said dielectric block is of a cubular configuration to define thereby the top surface, the bottom surface, a front side surface, a rear side surface, and first and second side surfaces of the dielectric block.

5. The filter construction of claim 1 wherein said input coupler is capacitively coupled to the coating formed by said means for maintaining the top and bottom surfaces of the dielectric block at the common electrical potential.

6. The filter construction of claim 1 wherein said input coupler is capacitively coupled to the first resonator of the at least one pair of coaxially-extending resonators formed to extend between the top and bottom surfaces of the dielectric block.

7. The filter construction of claim 1 wherein said output coupler is capacitively coupled to the coating formed by said means for maintaining the first and second sides of the dielectric block at the common electric potential.

8. The filter construction of claim 1 wherein said output coupler is capacitively coupled to the second resonator of the at least one pair of coaxially-extending resonators formed to extend between the top and bottom surfaces of the dielectric block.

9. The filter construction of claim 1 wherein said input coupler is formed of an electrically-conductive material coated upon one of the at least first and second side surfaces of the dielectric block and is electrically isolated from the coating formed by said means for maintaining the first and second sides of the dielectric block at the common electrical potential.

10. The filter construction of claim 1 wherein said output coupler is formed of an electrically-conductive material coated upon one of the at least first and second side surfaces of the dielectric block and is electrically isolated from the coating formed by said means for maintaining the first and second sides of the dielectric block at the common electrical potential.

11. A surface-mount filter construction mountable upon a circuit board, said filter construction comprised of a dielectric block having a pair of coaxially-extending resonators formed to extend between top and bottom surfaces of the dielectric block; input and output couplers formed of an electrically-conductive material disposed upon portions of a first side of the dielectric block; and a coating of an electrically-conductive material continuously covering the top and bottom surfaces of the dielectric block, sidewalls defining the resonators of said pair of coaxially-extending resonators, and side surfaces of the dielectric block except about peripheral portions of said input and output couplers, respectively, formed upon portions of said first side surface, such that said input coupler is capacitively coupled to the electrically-conductive material forming the coating which substantially covers the side surfaces of the dielectric block, and to a first resonator of the pair of coaxialy-extending resonators, and such that said output coupler is capacitively coupled to the electrically-conductive material forming the coating which substantially covers the side surfaces of the dielectric block, and to a second resonator of the pair of coaxially-extending resonators.

12. A transceiver for transmitting and receiving radio frequency signals, said transceiver comprising:

transmitter circuitry for generating a radio frequency signal;

receiver circuitry for receiving a radio frequency signal;

an antenna coupled to the transmitter circuitry and to the receiver circuitry for radiating the radio frequency signal supplied thereto and for receiving a radio frequency signal transmitted thereto;

a dielectric filter interconnecting the transmitter circuitry and the antenna for filtering the radio frequency signal generated by the transmitter circuitry, and interconnecting the receiver circuitry and the antenna for filtering the radio frequency signal received by the antenna, said dielectric filter comprising a dielectric block having first and second coaxially-extending resonators, respectively, formed to extend between top and bottom surfaces of the dielectric block; input and output couplers formed of an electrically-conductive material disposed upon portions of a first side of the dielectric block; and a coating of an electrically-conductive material continuously covering the top and bottom surfaces of the dielectric block, sidewalls defining the resonators of the first and second coaxially-extending resonators, and side surfaces of the dielectric block except about peripheral portions of said input and output couplers, respectively, formed upon portions of said first side surface, such that said input coupler is capacitively coupled to the electrically-conductive material forming the coating which substantially covers the side surfaces of the dielectric block and to the first coaxially-extending resonator, and such that said output coupler is capacitively coupled to the electrically-conductive material forming the coating which substantially covers the side surfaces of the dielectric block and to the second coaxially-extending resonator.

* * * * *